United States Patent [19]

Magami et al.

[11] 4,159,460

[45] Jun. 26, 1979

[54] VARIABLE RESISTOR

[75] Inventors: Kozo Magami; Masao Kasajima; Katsumi Takayanagi, all of Miyagi, Japan

[73] Assignee: Alps Electric Co., Ltd., Japan

[21] Appl. No.: 874,015

[22] Filed: Jan. 31, 1978

[30] Foreign Application Priority Data

Feb. 9, 1977 [JP] Japan ..... 52-14668[U]

[51] Int. Cl.[2] ..... H01C 10/32

[52] U.S. Cl. ..... 338/162; 338/174

[58] Field of Search ..... 338/174, 160, 162, 171, 338/97, 324, 325, 125–128, 185, 188, 190, 307, 308, 314, 328, 334

[56] References Cited

U.S. PATENT DOCUMENTS 3,965,454 6/1976 Puerner ..... 338/174

*Primary Examiner*—C. L. Albritton

*Attorney, Agent, or Firm*—Guy W. Shoup; Gerard F. Dunne

[57] ABSTRACT

A variable resistor adapted for use in tone control has an insulating substrate plate on which are formed two conductors. On the conductors are formed respective insulating films and, on the insulating films, a common resistance body. The ends of the conductors are positioned at an intermediate portion of the resistance body, so as to be short-circuited by a slide as the latter is brought to the intermediate portion of the resistance body.

3 Claims, 8 Drawing Figures

Fig. 1
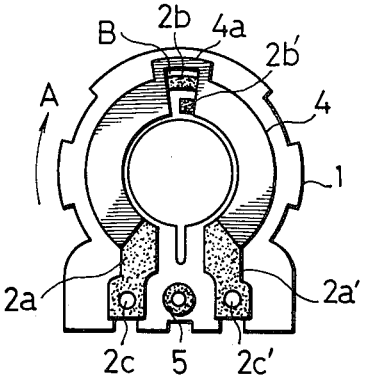
Fig. 2
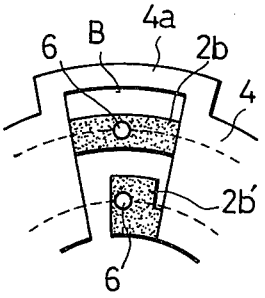
Fig. 3a
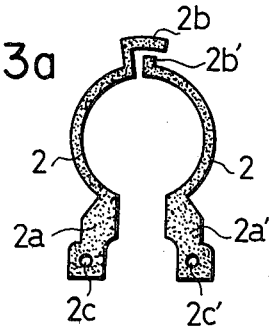
Fig. 3b
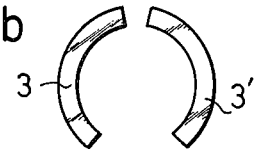
Fig. 3c
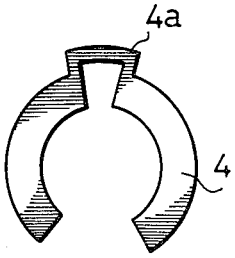
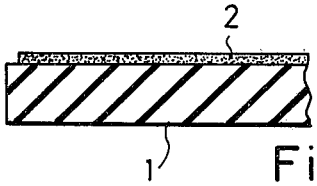
Fig. 4a
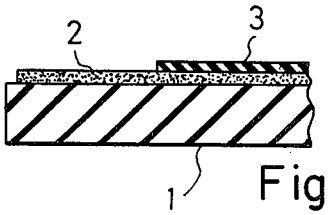
Fig. 4b
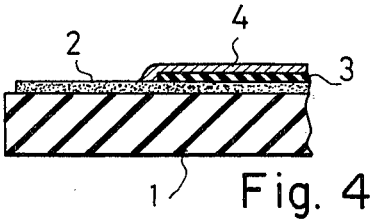
Fig. 4c

VARIABLE RESISTOR

BACKGROUND OF THE INVENTION

The present invention relates to variable resistors and, more particularly, to variable resistors suitable for use in tone control.

Generally, in such devices as stereo amplifiers, two kinds of variable resistors are used for adjusting high and low pitched tones, respectively. The arrangement is such that the levels of the high and low-pitched tones are increased or decreased as the slides of the variable resistors are rotated. When the slides are set at the intermediate positions on the resistances of the respective variable resistors, for obtaining intermediate tone levels, it is preferred that the increase and decrease of the level at high and low-pitched tones are avoided to realize a flat characteristic.

However, as a matter of fact, the physical intermediate position on the resistance often does not coincide with the electrical intermediate point, because of the fluctuations of the characteristics of resistances, capacitors and other electric parts incorporated in the tone control circuit, as well as the fluctuation of the characteristic of the variable resistor itself. For the above and other reasons, undulation of level at the intermediate position is likely caused, resulting in the fluctuation of frequency characteristics and tones.

SUMMARY OF THE INVENTION

It is therefore an object of the present invention to overcome the above described problems of the prior art by providing a variable resistor suitable for use in tone control, in which both end terminals of the resistance body are electrically short-circuited to an intermediate terminal, when the slide of the variable resistor is positioned at the intermediate position on the resistance body.

BRIEF DESCRIPTION OF THE DRAWINGS

FIG. 1 is a plan view of a variable resistor embodying the present invention, FIG. 2 is an enlarged view of essential parts of the variable resistor of FIG. 1, FIGS. 3*a* to 3*c* are illustrations of steps in the manufacturing process, and FIGS. 4*a* to 4*c* are sectional views of essential parts of a variable resistor under manufacture.

DETAILED DESCRIPTION OF THE PREFERRED EMBODIMENT

Referring to the drawings, a pair of conductors 2 are formed on an insulating substrate plate 1. The respective ends 2*b* and 2*b'* of these conductors are not directly connected to one another. The other ends of the conductors form terminal portions 2*a* and 2*a'* which have respective terminal attaching bores 2*c* and 2*c'*.

Respective insulating films 3 and 3' are placed, for example by coating, over portions of the conductors 2 other than the ends 2*b* and 2*b'* and terminal portions 2*a* and 2*a'*. A resistance body 4 is formed on the insulating films and connected electrically at its end portions to the terminal portions 2*a* and 2*a'*, as shown in FIG. 4(*c*).

The resistance body 4 is provided at its intermediate portion with a detouring portion 4*a* which detours about the ends 2*b* and 2*b'* of the conductors 2.

Reference numeral 5 denotes a conductive portion for attaching an intermediate terminal which is to be connected electrically to a collecting body which in turn is to be in contact with a slide. The collecting body is not shown in the drawings.

Referring now to FIGS. 3 and 4 showing the steps of manufacture of the variable resistor in accordance with the present invention, at first a pair of conductors 2 as shown in FIG. 3*a* is formed on the insulating substrate plate 1. Then, insulating films 3 and 3' of the shapes shown in FIG. 3*b* are formed on the conductors 2. Finally, a resistance body 4 having the shape shown in FIG. 3*c* is formed on the insulating films 3 and 3', to complete the variable resistor shown in FIG. 1.

FIGS. 4*a* to 4*c* are sectional views of essential parts of the variable resistor, corresponding to the respective steps of FIGS. 3*a* to 3*c*, and show the conductors 2, film 3 and resistance body 4 which are formed in sequence on the insulating substrate plate 1.

In operation, the slide which consists of two resistance body contacting portions 6 (See FIG. 2) is slid in the direction of arrow A (FIG. 1). As the slide reaches the intermediate region B between the low and high-pitched tone ranges (intermediate portion of the resistance body), the contacting portions 6 of the slide come into respective contact with the ends 2*b*,2*b'* of the pair of conductors 2, as shown in FIG. 2, so as to short circuit the terminal portions 2*a*,2*a'*, as well as the intermediate terminal, so as to separate the tone control circuit from other portions of the amplifier circuit.

Thus, according to the invention, there is provided a variable resistor in which a pair of conductors 2 having ends 2*b*,2*b'* positioned at the intermediate portion of the resistance body 4 are formed on the insulating plate 1, and the insulating film 3 and the resistance body are successively formed on the conductors 2.

It will be seen that the variable resistor of the invention having such a structure is compact and less expensive.

In addition, as the slide comes to the intermediate portion of the resistance body 4, the contacting portions 6 of the slide connect the conductors 2 to each other, so as to separate the tone control circuit from other circuit portions of the amplifier. Thus, the variable resistor of the invention is suitable for use in tone control.

It will be clear to those skilled in the art that the present invention is applicable not only to the described rotary type resistor but to linear slide type resistors as well.

What is claimed is:

1. A variable resistor comprising an electrically insulating substrate plate;

a resistance body carried by said substrate plate and having an intermediate portion;

two conductors provided on said substrate plate, said conductors each lying beneath said resistance body and each extending from a respective first end portion thereof near said intermediate portion to a respective second end portion thereof adapted to be connected to a respective terminal;

an insulating layer between each said conductor and said resistance body; and a slide adapted to contact both said first end portions when brought to said intermediate portion of said resistance body, so as to shortcircuit said conductors to one another.

2. A variable resistor according to claim 1, said first end portions each lying along the path of said slide along said resistance body; and said intermediate portion having a portion detouring about said first end portions.

3. A variable resistor according to claim 2, and first end portions lying in side-by-side relation on said substrate plate; and said slide being constituted by two portions each adapted to slidingly contact said resistance body and engage respective ones of said first end portion when brought to said intermediate portion.

* * * * *